US005774095A

United States Patent [19]

Louzir

[11] Patent Number: 5,774,095

[45] Date of Patent: Jun. 30, 1998

[54] HELICAL ANTENNA SYSTEM

[75] Inventor: Ali Louzir, Strasbourg, France

[73] Assignee: Thomson multimedia S.A., Courbevoie, France

[21] Appl. No.: 961,010

[22] Filed: Oct. 30, 1997

Related U.S. Application Data

[63] Continuation of Ser. No. 491,850, Jun. 23, 1996, abandoned.

[30] Foreign Application Priority Data

Dec. 30, 1992 [EP] European Pat. Off. ..... 92403593

[51] Int. Cl.[6] ..... H01Q 19/17; H01Q 21/24

[52] U.S. Cl. ..... 343/895; 343/840

[58] Field of Search ..... 343/895, 840, 343/753; H01Q 1/36, 19/17, 21/24, 11/08

[56] References Cited

U.S. PATENT DOCUMENTS 4,001,834 1/1977 Smith ..... 343/754

OTHER PUBLICATIONS

Patent Abstracts of Japan, vol. 3, No. 60 (E–112) Mar. 1979, JP 54038745 (Tanaka).

Patent Abstracts of Japan, vol. 13, No. 230 (E–764), May 1989), JP 10037107. (Ota).

*Primary Examiner*—Michael C. Wimer

*Attorney, Agent, or Firm*—Joseph S. Tripoli; Frederick A. Wein; Peter M. Emanuel

[57] ABSTRACT

A helical antenna system for receiving simultaneous signals with different polarizations, with the aid of helical feeders and without gain degradation. Two or more helical feeders are provided for each polarization direction.

1 Claim, 1 Drawing Sheet

HELICAL ANTENNA SYSTEM

This is a continuation of application Ser. No. 08/491,850, filed Jun. 23, 1995, abandoned.

BACKGROUND

The present invention relates to an antenna system having helical feeders.

A helical feeder antenna consists of a single conductor or multiple conductors wound into a helical shape. Beside some other possible modes a helical antenna is normally used in a so-called axial mode or in a normal mode. The axial mode provides maximum radiation along the helix axis, which occurs when the helix circumference is of the order of one wavelength. The normal mode which yields radiation broadside to the helix axis, occurs when the helix diameter is small with respect to a wavelength. For the application according to the present invention the axial mode is of special interest.

The use of helical antennas for antenna systems are widely known. For example U.S. Pat. No. 3,184,747 presents a coaxial feed helical antenna which has a director disk between feed and helix producing endfire radiation towards the disk. In this US-patent the dimensions of the helix for such an antenna system are given.

U.S. Pat. No. 4,742,359 presents an antenna system using a helical antenna with two ends where the first end is linked to a feeder line. For the purpose of the following explanation it is understood that the feeder line is aligned with the axis of the helical antenna. Such a helical antenna may be built as a so-called endfire helical antenna, where under maximum received power conditions the direction of the signal power flow at the first end is in the sane direction as the received radiation. Such a helical antenna can also be built as a so-called backfire helical antenna, where under maximum received power conditions the direction of the signal power flow at the first end is in the opposite direction to the received radiation.

In said US patent an antenna system is presented, which comprises a reflector, a primary helical antenna having a coil with a pair of ends, said coil located at the focal point of said reflector so that the axis of the helical antenna coincides essentially with the axis of said reflector. A feeder line couples the antenna system with an external circuit, so that said primary helical antenna represents a backfire helical antenna coupled with said feeder line at the nearer and from said reflector and the other end of the helical antenna is free standing, and said feeder line is a coaxial cable.

It is further known from the international publication WO 92/13373 so use one or more helical feeders together with a dielectric lens. Thereby signals from several directions can be received simultaneously.

In the axial mode a helix wound like a right-hand screw receives right-hand circular polarization, while a helix wound like a left-hand screw receives left-hand polarization.

If both polarization directions are to be received simultaneously there must be provided at least two helices. If these helices are part of an antenna system using focussing means, it is impossible to have at the same time the two feeders in the focal point of the focussing means. Thereby inacceptable gain degradation is involved for at least one of the polarization directions. Additionally it is possible that cross-talk occurs due to inevitable defocussing and/or strong coupling between the helices if placed too close to each other.

It is an object of the present invention to present an antenna system with focussing means and helical feeders where at least two different circular polarized radiations can be received simultaneously with no gain degradation compared to known systems.

According to the invention there is not just one helical feeder provided for each polarization direction, but two or more. These helical feeders work preferably in the axial backfire mode.

The following ideas have led to the principle of the present invention.

Means for focussing, e.g. a parabolic reflector, a dielectric lens, like a Luneburg-type lens, or the like, have a focal point in which they focus an incoming radiation. If radiations with two opposite polarizations are to be received two helical feeders are to be provided near the focal point. That means that the two helices cannot be located together at the focal point. To compensate the according gain degradation there are two or more helices for each polarization direction provided according to the present invention.

Further characteristics, advantages and details of the invention are explained in the following embodiments with the aid of the drawings. Therein

DETAILED DESCRIPTION OF THE PREFERRED EMBODIMENT

Figure 1:
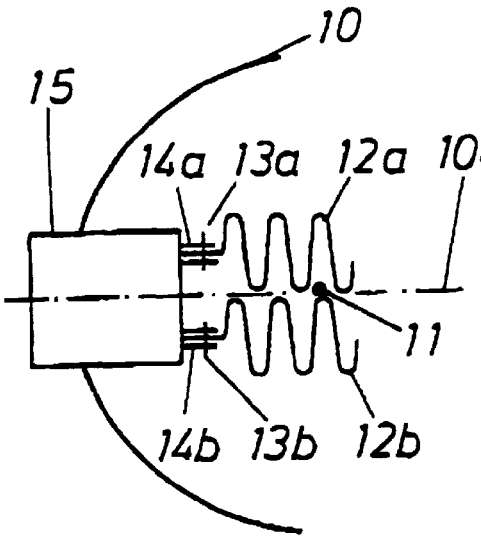
FIG. 1 shows a side view of a preferred embodiment.

In FIG. 1 a parabolic reflector 10 acts as focus means and has a reflector axis 10*a* and a focal point 11. Around this focal point 11 there are two helical feeders 12*a*, 12*b* provided which have the same winding sense and receive mainly radiation with the same circular polarization. Each of the helical feeders 12*a*, 12*b* has a director disk 13*a*, 13*b* respectively. Signals received by the feeders 12*a*, 12*b* are led via feeder lines 14*a*, 14*b* respectively, which may be e.g. coaxial cables, semi-rigid cables or the like, to circuit boards which are included in a housing 15 and which cannot be seen in FIG. 1.

Figure 2:
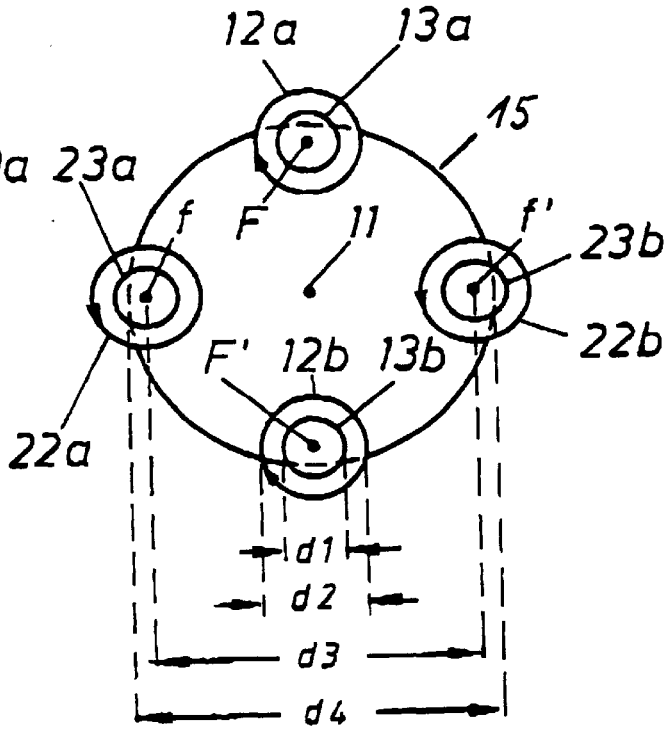
FIG. 2 shows a front view of the preferred embodiment

Additionally there is a second pair of helical feeders 22*a*, 22*b* provided with an oppositional winding sense compared to the feeders 12*a*, 12*b*. These feeders 22*a*, 22*b* cannot be seen in FIG. 1 but can be seen in FIG. 2, which gives a front view of this embodiment. Each of the feeders 22*a*, 22*b* has a director disk 23*a*, 23*b* respectively.

The diameter d1 of the director disks 13*a*, 13*b*, 23*a*, 23*b* is about $$0.25*La,$$

wherein La is the wavelength of the radiation to be received.

For the preferred embodiment the diameter d2 of the helices 12*a*, 12*b* 22*a*, 22*b* is about $$0.3*La,$$

the distance d3 between the centers of two helices 12*a*, 12*b* or 22*a*, 22*b* respectively of the same pair is about $$0.7*La.$$

In this embodiment the housing 15 is shaped like a tube with a round basic form having a diameter d4 of about 0.8* La.

For each pairs the helices 12*a*, 12*b* or 22*a*, 22*b* respectively are placed symmetrically on either side of the focal point 11 in such way that the center of the segment F–F' or f–f' respectively is coincident with the focal point 11 of the concentration means 10.

The input powers of each sense of polarization are added inside the housing 15 using an according power combiner. A preferred embodiment of such a power combiner is shown just for one polarization sense in FIG. 3. There the inner conductors of the feeder lines 14 *a*, 14*b* are led to microstrip lines 16*a*, 16*b* respectively which have a common junction point 17. A resulting outline 18 is led to further stages (not shown) of a low noise converter (LNC). If the signal to be received is a television-broadcast signal, the information of the signals can be presented by an according TV-set.

Figure 3:
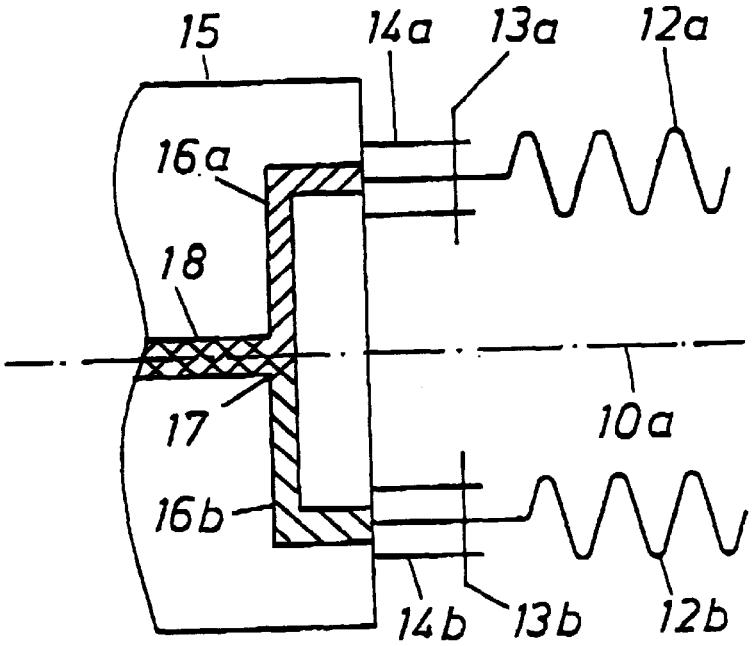
FIG. 3 shows a preferred embodiment of a power combiner.

For the other polarization sense another power combiner is provided which may be of the same type as shown in FIG. 3.

For processing the signals received by the feeders 12*a*, 12*b* 22*a*, 22*b* two LNC circuit boards can be provided which could be orthogonal to each other, e.g. such that they build a cross, a "T" or the like, and they are enclosed in the housing 15 which may be shaped like a tube, with a round, a triangular, a quadrangular basic form or the like.

Versions of the presented embodiments may include at least one of the following variations:

it is possible to provide more than two helical feeders for the reception of each polarization direction. In such a case the phase centers F, f build a triangle, a quadrangle or the like. It is preferred to place the helical feeders such that the center of the triangle, the quadrangle or the like is coincident with the focal point 11;

instead of the reflector 10 any other focal means can be used which work by reflection, refraction and/or diffraction. Another preferred focal means is a Luneburg-type lens, which can be spherical, hemi-spherical, quarter-spherical or the like;

by connecting helical feeders of the first pair (12*a*, 12*b*) with those of the second pair (22*a*, 22*b*) linear polarized signals can be received. The linear polarization direction can be selected by according phase shifter means;

the antenna system can be used for the reception of broadcast signals, like television signals, audio-broadcast signals or the like, which can be transmitted directly or not directly from a satellite. The antenna system can also be used for the reception of any other radiofrequency signals with different polarizations.

I claim:

1. Antenna system comprising:

focusing means and helical feeders working in the axial backfire mode;

a first group of two or more helical feeders provided for reception of a first polarization direction; and a second group of two or more helical feeders being provided for reception of a second polarization direction;

the first group of helical feeders having an opposite winding to the second group of helical feeders and disposed so that a center point of phase centers of each group of helical feeders is coincident with a focal point of the focusing means, and for the processing of signals of each polarization to be received, and a plurality of circuit boards are provided and said circuit boards are positioned orthogonal to each other.

* * * * *